United States Patent [19]

Hutchison

[11] 4,064,591

[45] Dec. 27, 1977

[54] LIFTING MECHANISM FOR SLIDING DOORS

[75] Inventor: John W. Hutchison, Crown Point, Ind.

[73] Assignee: Pullman Incorporated, Chicago, Ill.

[21] Appl. No.: 703,861

[22] Filed: July 9, 1976

Related U.S. Application Data

[62] Division of Ser. No. 599,791, July 28, 1975, Pat. No. 3,988,801.

[51] Int. Cl.[2] ..... E05D 13/00

[52] U.S. Cl. ..... 16/99; 49/235; 248/188.1

[58] Field of Search ..... 16/96 R, 97, 99, DIG. 5; 49/425, 235; 254/94; 292/26, 28, 37, 40, 48, 50, DIG. 32; 248/188.1

[56] References Cited

U.S. PATENT DOCUMENTS

| | | | |
|---|---|---|---|
| 1,804,329 | 5/1931 | Farr | 16/96 R |
| 1,949,805 | 3/1934 | McGrary et al. | 16/96 R |
| 2,223,760 | 12/1940 | Haaser | 292/48 |
| 2,225,679 | 12/1940 | Beauchamp | 16/99 X |
| 2,488,634 | 11/1949 | Madland | 16/99 |
| 2,827,115 | 3/1958 | Stroup | 16/97 X |
| 3,093,091 | 6/1963 | Tax et al. | 16/97 X |
| 3,440,682 | 4/1969 | Olander | 16/99 |

*Primary Examiner*—Werner H. Schroeder
*Assistant Examiner*—Moshe I. Cohen
*Attorney, Agent, or Firm*—John A. Doninger

[57] ABSTRACT

A sliding door includes a roller lifting mechanism provided by horizontally spaced bell cranks to which rollers are connected and which may be pivoted downwardly to engage a door track for raising the door so that it may be laterally moved to one side of the door opening. The lifting mechanism includes a cam element which is manually rotated to exert a push force on the bell crank levers for pivoting the same into the lift position. A modified version of the lift mechanism includes a linkage arrangement which exerts a pulling action on the bell cranks for achieving the lifting function.

6 Claims, 8 Drawing Figures

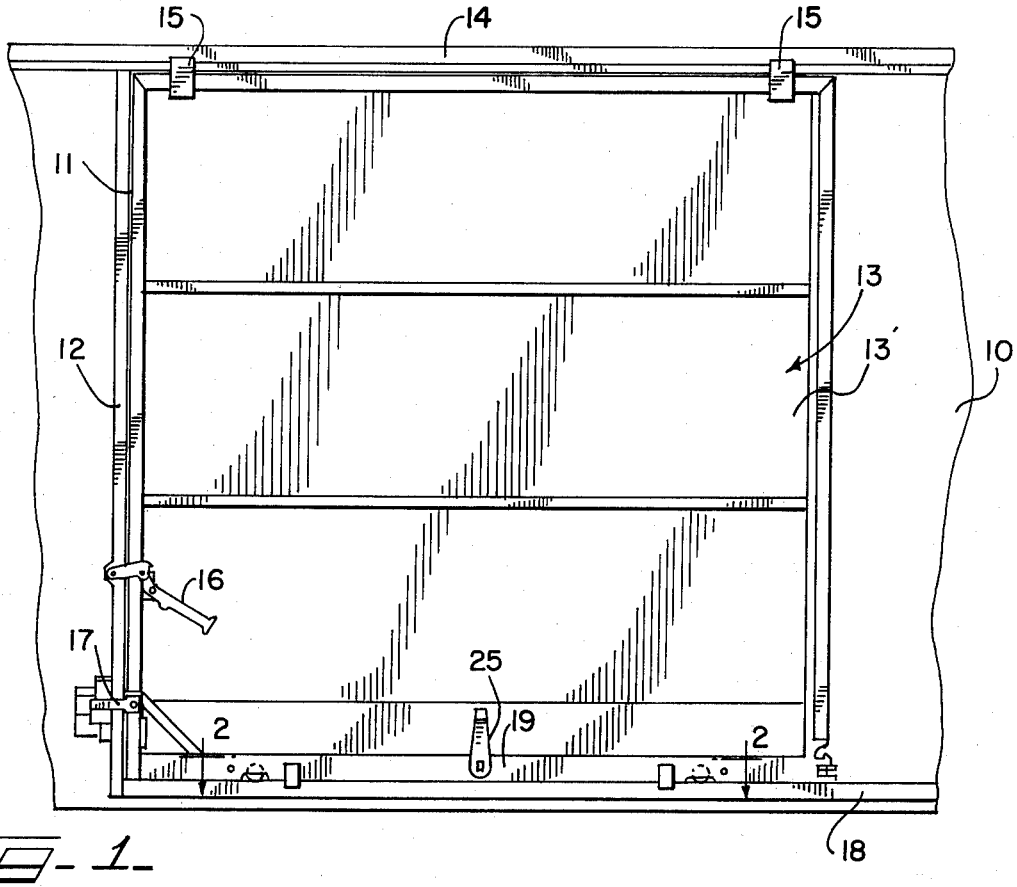
FIG. 1
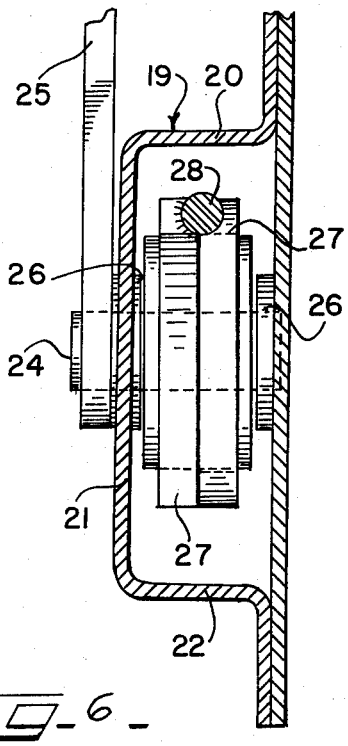
FIG. 6
FIG. 5
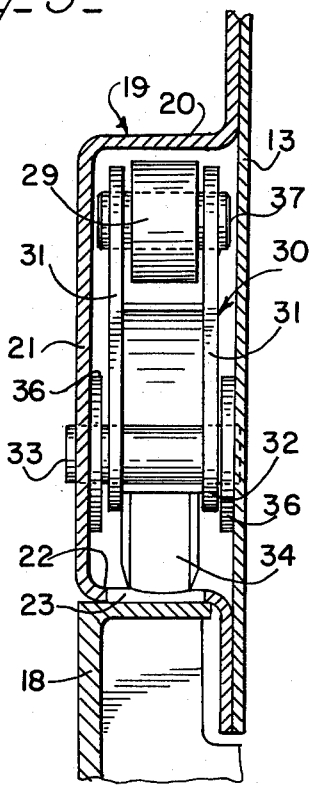

LIFTING MECHANISM FOR SLIDING DOORS

This is a division of Ser. No. 599,791, filed July 28, 1975, now U.S. Pat. No. 3,988,801.

BACKGROUND OF THE INVENTION

1. Field of the Invention

This invention relates to the railway art and particularly to railway boxcars provided with sliding doors which include a lifting arrangement for lifting the doors upwardly whereupon they then may be moved on rollers supported on a track to an open position.

2. Description of the Prior Art

The prior art includes U.S. Pat. Nos.: 2,386,404, Oct. 9, 1945; 2,387,161, Oct. 16, 1945; 2,488,634, Nov. 22, 1949; 2,494,467, Jan. 10, 1950 and 2,511,570, June 13, 1950. The present invention is an improvement over the prior art patents in that it provides a more effective and positive lifting mechanism for sliding doors which is more durable providing less maintenance and which is more easily operable in the lifting function of the door.

SUMMARY

The lifting arrangement for railway car sliding doors includes a pair of horizontally spaced bell crank levers, which are provided at the lower portion of the sliding door adjacent opposite sides thereof. Each of the bell crank levers includes an arm supporting a roller which is adapted to be moved downwardly into engagement with a track on the boxcar, whereupon the door may be manually lifted and moved on the rollers supported on the track to one side of the door opening. This lifting mechanism includes a pair of links which are connected to cam members or plates positioned in overlapping relation at the center line of the door. The shaft is rotatably mounted on the door and includes a handle which is manually operated. The cam plates each include an opening and each opening defines a cam engagable surface with the surface of one plate being positioned on one side of the rotating shaft and the surface of the other cam plate being positioned on the other side of the shaft, so that the cam plates are in overlapping relation. A rotatable shaft extends through the opening and includes a cam element which, upon rotation of the shaft, engages the cam engagable surfaces defined by the openings, whereupon the cam plates are moved to exert a pulling force on the bell crank levers thereby rotating the same and moving the rollers into engagement downwardly with the track so that the door may be raised and moved on the rollers to an open position.

A modified form of the invention also includes a bell crank lever arrangement and linkages are provided which exert only a pulling force in the actuation of the bell crank levers to the lift position whereupon the rollers are journaled on the track for raising and moving the door to one side of the door opening.

BRIEF DESCRIPTION OF THE DRAWINGS

FIG. 1 is a side elevational view of a portion of a railway boxcar having a sliding door embodying the present invention;

FIG. 5 is a cross-sectional view taken substantially along the line 5—5 of FIG. 3;

FIG. 6 is a cross-sectional view taken substantially along the line 6—6 of FIG. 3;

DESCRIPTION OF THE PREFERRED EMBODIMENT

Figures 2, 3, 4:
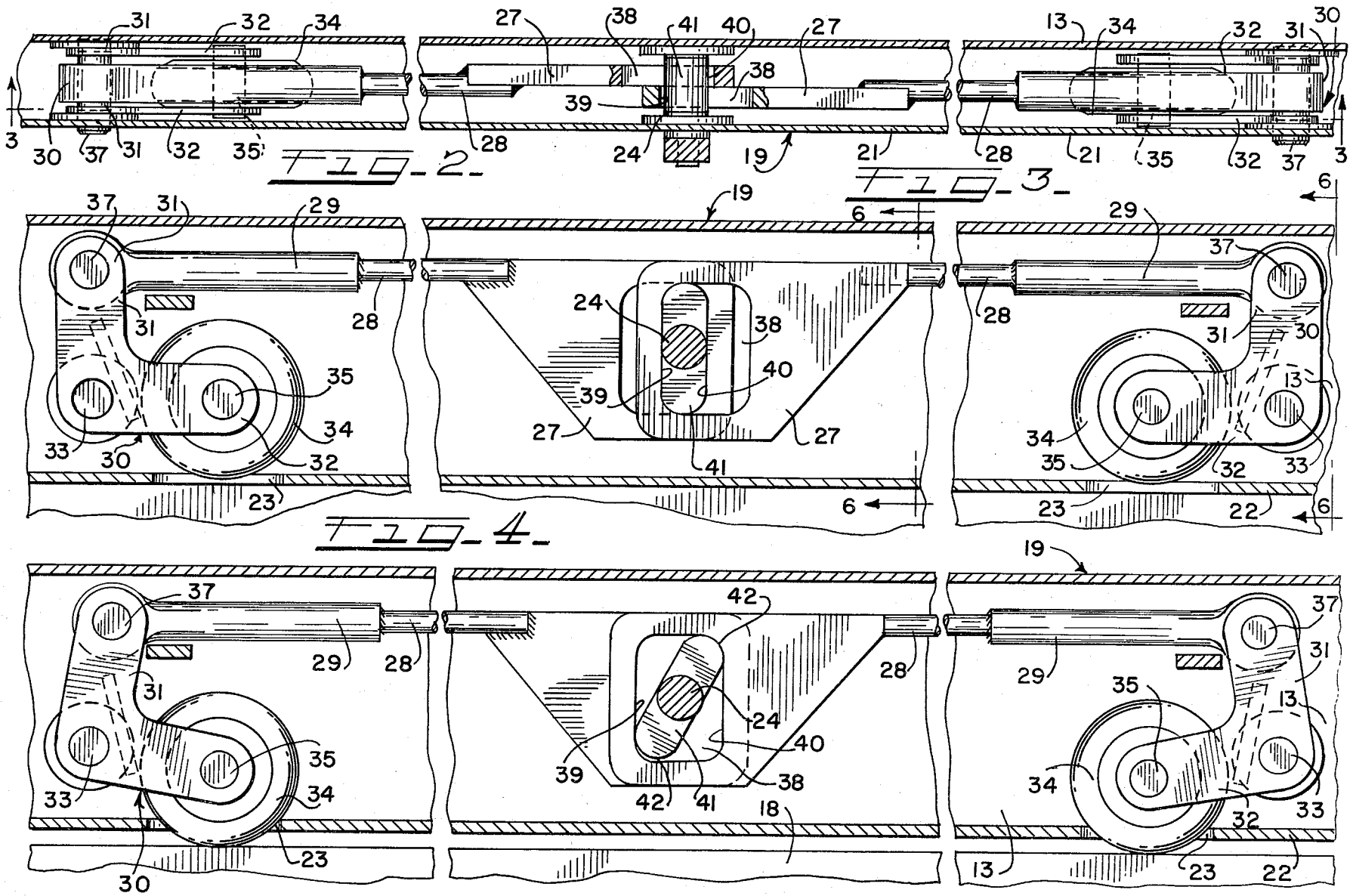
FIG. 2 is a cross-sectional view taken substantially along the line 2—2 of FIG. 1.
FIG. 3 is a cross-sectional view taken substantially along the line 3—3 of FIG. 2.
FIG. 4 is a view similar to FIG. 3, disclosing another operating condition of the invention.

With reference now to the drawings and in particular to FIG. 1, a railway boxcar includes a boxcar sidewall 10, provided with a door opening 11 formed in a door frame 12. A sliding door is generally designated as 13, this type of door being of a type which is vertically movable in the door frame 12, whereupon it can then be easily moved to one side of the door opening 11. The door 13 includes a vertical panel structure 13'. It is guided at its upper end by means of an upper header structure 14 engaged by suitable slides 15. One side of the door is provided with the conventional door opening and a closing leverage mechanism designated at 16 and a conventional door locking mechanism at 17. A track 18, is suitably supported on the side wall 10 below the door opening 11.

Referring now particularly to FIGS. 2 through 6, the lower end of the door 13 is provided with a box-shaped housing 19, including an upper wall 20, a vertical wall 21, and a lower wall 22. The lower wall 22 is provided with horizontally spaced vertical openings 23. A shaft 24, is rotatably supported centrally on the door 13 so as to be readily accessible to an operator who may manually rotate the shaft 24 by means of a handle 25 connected thereto. The shaft 24 is rotatably supported in bearings 26 as best shown in FIG. 6 supported within the housing structure 19. A pair of vertical thrust or cam plates 27 are positioned in overlapping relation and each is connected to a link 28 and a connecting rod 29, in turn connected to a pair of bell cranks 30, which are positioned within the housing on opposite sides of the door 13. Each of the bell crank levers 30 consists of identical spaced plates providing for each lever a vertical arm 31 and a horizontal arm 32. A fulcrum pivot member 33 is suitably supported in bearings 36 disposed within the housing as best shown in FIG. 5. The fulcrum pivot 33 extends through the fulcrum point of the bell crank arms 31 and 32. Rollers 34 are journaled by means of pins 35, on the ends of the horizontal arm 32. A pivot pin 37 is connected to each of the vertical arms 31 and to the end portion of the links 29.

Referring now to FIGS. 2, 3, and 4, each of the thrust or cam plates 27 is provided with a rectangular opening 38, each of said openings 38 defining cam engagable surfaces 39 and 40. The ends of the cam plates 27 overlap and thus the cam engagable surface 39 of one of the thrust plates 27 is disposed on side of the shaft 24, and the cam engagable surface 40 of the other thrust plate 27, is disposed on the opposite side of the shaft 24 as best shown in FIG. 2. The shaft has connected thereto for rotation therewith, a cam 41 which is adapted to engage each of the cam engagable surfaces 39 and 40. The cam 41 is provided with arcuate cam ends 42.

OPERATION OF THE PREFERRED EMBODIMENT

When the door is in a closed or non-sliding position, the lift mechanism is in a retracted position as shown in FIGS. 2 and 3. In this position the door is solidly seated within the door opening of the car and is securely locked. Since the door is thus firmly seated within the frame, it provides for a good sealing condition with respect to the frame structure and wear on the door is reduced since the entire lower end of the door is firmly supported within the frame structure. The door is solidly supported on the track and thus during train operations and certain impacts, the frictional engagement between the track and the door and the frame is such that the forces on the lock mechanism are greatly reduced as compared to a door which is constantly supported on a roller structure and which is not in a recessed position when the door is closed. Many of the conventional sliding doors are thus constantly supported on a roller structure which, of course, does not provide the advantages of the type of door disclosed in the present invention. Assuming now that the operator wishes to open the door and move it to one side of the door opening, he merely rotates the handle 25 and shaft 24 from the position shown in FIGS. 2 and 3 whereupon the cam ends 42 engage the cam engagable surfaces 39 and 40 moving the cam plates in further overlapping relation until the openings 38 are in complete alignment as shown in FIG. 4. This provides for an inward pulling force on the links 28 and connectors 29, thereby pivoting the bell cranks 30 from the position shown in FIG. 3 to the position shown in FIG. 4 whereupon now the rollers 34 have moved outwardly through the openings 23, into engagement with the top of the track 18 so that the door is now lifted upwardly and is in rolling relation with respect to the track.

FIG. 5 shows the door seated upon the track in a non-rolling relation. It is of course obvious that the wheel 34 is lowered through the opening 23 and as it is lowered and forced downwardly, the door then will be raised to the position where it is now readily slidable on the track to one side of the door opening. When the operator has moved it to one side of the door opening, he thereupon releases the handle and rotates the shaft whereupon the bell crank levers again assume the retracted position shown in FIG. 3.

DESCRIPTION OF A MODIFIED FORM OF THE INVENTION

Figure 7:
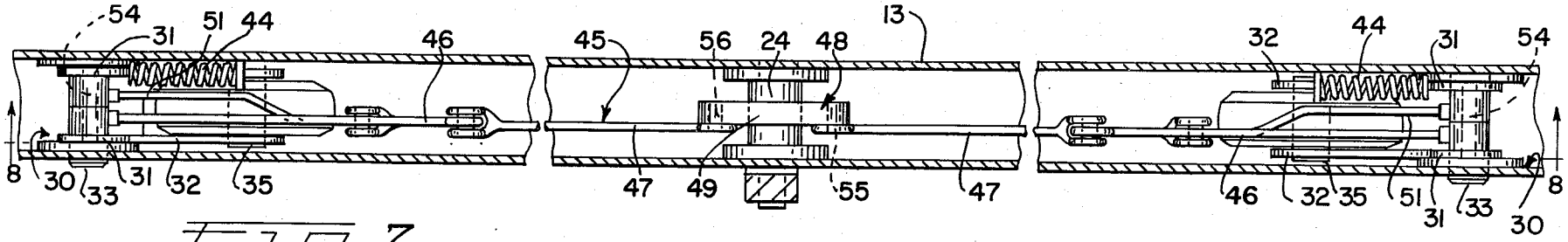
FIG. 7 is a cross-sectional view similar to FIG. 2 disclosing a modified embodiment of the invention.
Figure 8:
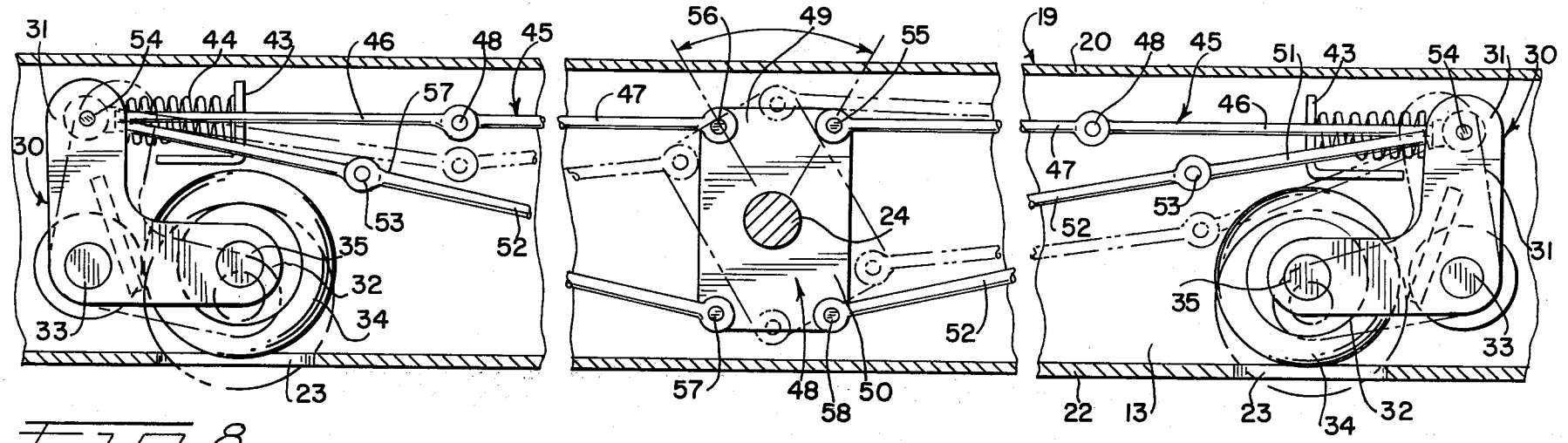
FIG. 8 is a cross-sectional view taken substantially along the line 8—8 of FIG. 7.

Referring now particularly to FIGS. 7 and 8, a modified form of the invention is disclosed. The housing and bell crank levers are designated by the same reference character as disclosed in FIGS. 3, 4, and 5 of the preferred embodiment. In addition, in this particular modification, the housing is also provided with spring brackets 43, which include a spring 44 in engagement with the vertical arms 31 of the bell crank levers 30 for urging the same to the recessed position shown in the solid lines of FIG. 8. The improvement also includes a pull type of linkage arrangement generally designated at 45, which includes first links 46 in turn connected to second links 47 by means of pivot connections 48. The shaft 24 supports a rockable plate member 48 of rectangular design including an upper portion 49 and lower portion 50. Third and fourth diagonally extending links 51 and 52 are pivotably interconnected by pivot means 53. The links 51 are pivotally interconnected by pivot means 54 to the vertical arms 31. The links 47 are in turn pivotally connected by means of pivot pins 55 and 56 to the upper portion 49 of the rockable plate member 48. Pivot pins 57 and 58 respectively connect the links 52 to the lower portion 50 of the rockable plate member 48.

OPERATION OF THE MODIFICATION

As indicated above, the spring 44 normally retains the bell crank levers in the full line position shown in FIG. 8. Assuming now that the operator wishes to rotate the rollers 34 downwardly into engagement with the track 18 he moves the handle 25 thereby rocking the rockable plate member 48 to the dotted line position shown in FIG. 8. Upon movement to this position the right hand first and second links 46 and 47 exert a pulling force to move the right hand bell crank lever to the dotted line position whereupon the right hand roller is disposed below the door for support on the track. Simultaneously the third and fourth links 51 and 52 are pulled so that the left hand bell crank lever is pivoted to the dotted line position with the roller supported on the track. During this movement, therefore, one of the upper linkage sections or arrangements exerts a pulling force and the other upper linkage section or arrangement is slightly collapsed as shown in the drawing. Similarly, during this movement, one of the lower linkage sections or arrangements exerts a pulling force while the other lower linkage section or arrangement is slightly collapsed as indicated. Thus it is clear that only a pulling force is applied in this arrangement which is particularly effective in that the linkages do not conflict or fight each other when one goes into compression and the other goes into tension as may be the case in conventional push pull type of arrangements. Thus only a pull type of situation is disclosed and this is particularly effective in the smooth operation of the lifting mechanism. Thus the advantages which accrue to a liftable door are particularly found in the present invention, in view of the unique lifting arrangement. The door is firmly fixed in the opening when in a closed position, or when the door is at rest in an open position. When closing movement or sliding movement of the door is desired, it is a simple matter to actuate the mechanism which will then provide for ease of movement of the door to the desired position. The spring arrangement 44 is effective to return the bell crank levers and plate 48 to the full line position at FIG. 8.

The foregoing description and drawings merely explain and illustrate the invention, and the invention is not limited thereto, except insofar as the appendant claims are so limited, as those skilled in the arts will have the disclosure before them and be able to make modifications and variations therein without departing from the scope of the invention.

I claim:

1. A sliding door including a vertical door panel, a track positioned below said door for slideably supporting the same, the improvement of a door lifting mechanism comprising;

a pair of bell crank levers each including a horizontally disposed arm and a vertically disposed arm, means pivotally supporting said bell crank levers on said panel in horizontally spaced relation, a roller journalled on each of said horizontal arms, a shaft rotatably supported on said panel between said levers, a pair of pull type linkage arrangements each pivotally connected to a respective vertical arm of a respective lever, each linkage arrangement having independent upper and lower sections, each of said upper and lower link sections comprising a plurality of pivotally interconnected link portions to define a flexible link to accommodate pulling action and eliminate pushing action, and a vertically extending rockable member connected to said shaft and having upper and lower portions connected respectively to said upper and lower sections of each of said linkage arrangements and exerting pull forces on said linkage arrangement for pivoting said bell crank levers during rotation of said shaft to pivot said rollers into and out of lifting engagement relative to said track.

2. The invention in accordance with claim 1, said rockable member comprising a vertical plate provided with said upper and lower portions, said upper sections including upper link elements pivotally connected to the upper portion and extending horizontally toward said levers, means pivotally connecting said upper link elements to said vertical arms, and said lower sections including lower link elements pivotally connected to said lower portions and extending toward respective levers, and means pivotally connecting said lower link elements to said vertical arms of respective levers.

3. The invention in accordance with claim 2 including biasing means on said panel connected to said levers for biasing said levers from a door lifting position.

4. The invention in accordance with claim 3, each said link elements each including a pair of pivotally interconnected links.

5. The invention in accordance with claim 2, said lower link elements extending diagonally upwardly from the connection to said lower portion of said vertical plate and being connected to said vertical arm concentrically with said upper link elements.

6. The invention according to claim 5, and said upper and lower sections being arranged to be loaded alternatively in tension.

* * * * *